US005662190A

United States Patent [19]

Abe

[11] Patent Number: 5,662,190

[45] Date of Patent: Sep. 2, 1997

[54] SELF-SCANNING CHECKOUT APPARATUS HAVING ARTICLE PASSAGE DETECTING SENSOR

[75] Inventor: Satoru Abe, Mishima, Japan

[73] Assignee: Kabushiki Kaisha TEC, Shizuoka, Japan

[21] Appl. No.: 453,021

[22] Filed: May 30, 1995

[30] Foreign Application Priority Data

May 30, 1994 [JP] Japan ..... 6-115776

[51] Int. Cl.[6] ..... A47F 10/02

[52] U.S. Cl. ..... 186/61; 235/383

[58] Field of Search ..... 186/61; 235/383

[56] References Cited

U.S. PATENT DOCUMENTS

| | | | |
|---|---|---|---|
| 4,787,467 | 11/1988 | Johnson | 235/383 X |
| 5,375,680 | 12/1994 | Ikeda et al. | 186/61 |
| 5,437,346 | 8/1995 | Dumont | 186/61 |

FOREIGN PATENT DOCUMENTS

| | | |
|---|---|---|
| 3-238587 | 10/1991 | Japan . |
| 6-64645 | 8/1994 | Japan . |

*Primary Examiner*—F. J. Bartuska

*Attorney, Agent, or Firm*—Frishauf, Holtz, Goodman, Langer & Chick

[57] ABSTRACT

A self-scanning checkout apparatus for reading article information of articles to be purchased during a checkout operation carried out individually by a customer and for determining whether the check-out operation individually carried out by the customer is normal or abnormal. The self-scanning checkout apparatus includes a first holding section for holding articles to be purchased whose article information is not yet read; a reading device, operable individually by the customer, for reading article information of the articles to be purchased; a second holding section for holding articles to be purchased whose information has been read; a registering device for registering the article information read by the reading device; a passage detecting device, disposed between the first and second holding sections and in the vicinity of the reading device, for detecting passage of articles; and a weight variation detecting device, disposed on the second holding section and in the vicinity of the passage detecting device, for detecting a variation in the weight of articles held by the second holding section. A determining device determines whether the checkout process carried out individually by the customer is normal or abnormal based on outputs from the registering device, the passage detecting device and the weight variation detecting device respectively indicating the detection or non-detection of registration of an article, passage of the article and a weight variation in the weight of articles held by the second holding section.

10 Claims, 8 Drawing Sheets

SELF-SCANNING CHECKOUT APPARATUS HAVING ARTICLE PASSAGE DETECTING SENSOR

BACKGROUND OF THE INVENTION

1. Field of the Invention

This invention relates to a self-scanning checkout apparatus for permitting a customer himself to scan article data of articles purchased by the customer so as to register the articles for sale.

2. Description of the Related Art

Recently, in a checkout apparatus for settling accounts of articles in a retail shop, for example, a self-scanning checkout apparatus for permitting a customer himself to scan article data of purchased articles has been developed so as to register the articles. As one example of this type of self-scanning checkout apparatus, a self-scanning checkout apparatus disclosed in U.S. application Ser. No. 08/328,107 is known.

In such a self-scanning checkout apparatus, a two-lane (plural-lane) type apparatus is used to permit a plurality of customers to settle accounts with a single cashier. In this apparatus, a stationary scanner for permitting the customer to scan an article is provided, an upstream-side basket placing table on which unregistered articles are placed is disposed in front of the stationary scanner and a downstream-side basket placing table on which registered articles are placed is disposed in the rear position of the stationary scanner.

First, the customer puts an article to be scanned on the upstream-side basket placing table, scans the article one by one by use of the stationary scanner, and puts the article on the downstream-side basket placing table. Then, after all of the articles to be purchased are scanned, the total amount of money for the articles is displayed on a display connected to the stationary scanner according to article data input via the scanner and a receipt having the total amount and the like printed thereon is output.

Then, the customer pays money corresponding to the total amount of money to the cashier and the cashier gives the change to the customer together with the receipt and a bag for putting the articles therein.

At this time, a next customer is scanning articles to be purchased, and in the case of a two-lane checkout apparatus, a customer on the other lane is scanning articles to be purchased. Therefore, in comparison with a case wherein one cashier effects the scanning operation and settlement service, the efficiency of the service can be significantly enhanced and the labor cost can be markedly lowered.

However, a case wherein the customer erroneously or intentionally passes an article along the scanner without being scanned and places the article on the downstream-side basket placing table is considered. In this case, the article is put into a bag without counting up the price thereof and it becomes a loss for the shop. In order to prevent this problem, it is required for the cashier to keep a careful watch on the operation of the customer so as to prevent occurrence of the above problem and to advise the customer to effect normal scanning when the cashier has detected occurrence of the above problem. However, if the cashier is required to give advice and guidance to a plurality of customers, the mental load of the cashier becomes heavy and the efficiency of the service is lowered.

SUMMARY OF THE INVENTION

An object of this invention is to provide a self-scanning checkout apparatus for permitting a cashier to easily and unfailingly detect that an article which has not yet been registered is placed on a registered article placing table when a customer has either erroneously or intentionally improperly placed the not yet registered article on the registered article placing table.

A self-scanning checkout apparatus of this invention comprises a checkout apparatus for reading information et to an article by an article scanning operation carried out by the customer himself so as to register the article based on the read information. The apparatus includes first holding means for holding an article whose article information is not yet read; means for reading information of the article; second holding means for holding the article whose information has been read; means for registering the information read by the reading means; means disposed between the first and second holding means, for detecting passage of the article; means disposed on at least one of the first and second holding means, for detecting a variation in the weight of an object held by the holding means; and means for determining whether the checkout process by the customer is normal or abnormal based on outputs indicating the detection or non-detection of the registration of the article, the passage of the article and a variation in the weight and respectively supplied from the registering means, the passage detecting means and the weight variation detecting means.

According to the present invention with the above construction, the customer who checks out the articles first places all of the articles on the upstream-side article table which is the first holding means. Then, the customer takes out one of the articles, causes the stationary scanner which is the reading means to read the information of the article, passes the article along the optical sensor which is the passage detection means, and places the article on the downstream-side article table which is the second holding means. The above operation is effected for all of the articles, but at this time, in the checkout apparatus of this invention, a variation in the weight caused by the movement of the articles is detected by use of a scale which is the weight variation detecting means mounted on at least one of the upstream-side article table and downstream-side article table. Further, the passage of the article is detected by the optical Sensor which is the passage detection means and the registration of the article is recognized by the registering means including a CPU and a memory and receives article information from the scanner which is the reading means. The three results of recognition (weight variation, passage of the article, registration of the article) are supplied to the determining means and it is determined that the checkout process of the customer is abnormal when at least one of the "recognized" results is not supplied. The cashier can thus easily and unfailingly get information that an article which has not been registered by use of the scanner has been either erroneously or intentionally placed on the registered article table by use of a lamp or the like which informs the result of determination.

Further, the checkout apparatus of this invention not only unconditionally determines that an abnormal condition occurs when at least one of the "recognized" results is not obtained but also gives an adequate advice to the customer as follows by adequately providing display means such as a display unit connected to the determining means.

That is, as one example (when the scale is mounted on the upstream-side article table), if the article registration and weight variation are detected and the article passage is not detected, it is determined that the customer has scanned the article, but does not place the article on the registered (downstream-side) article table, and the article placement guidance for adequately placing the article is displayed.

Further, if the article registration is not detected and the article passage and weight variation are detected, it is determined that the customer has taken out the article from the upstream-side article table, carried the article to scan the article, but failed to scan the article, and then placed the article on the registered article table without noticing the failure of scanning, and the instruction for scanning is displayed.

Further, if neither the article registration nor the article passage is detected and only the weight variation is detected, it is determined that the customer has taken out the article from the upstream-side article table and may have put the article on the downstream-side article table without scanning the article and passing the article along the passage detection sensor, and caution is displayed.

With the above design, the management of the checkout process of the customer which was attained by visual observation of the cashier in the prior art can be achieved by the automatic observing and instructing functions of the checkout apparatus.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
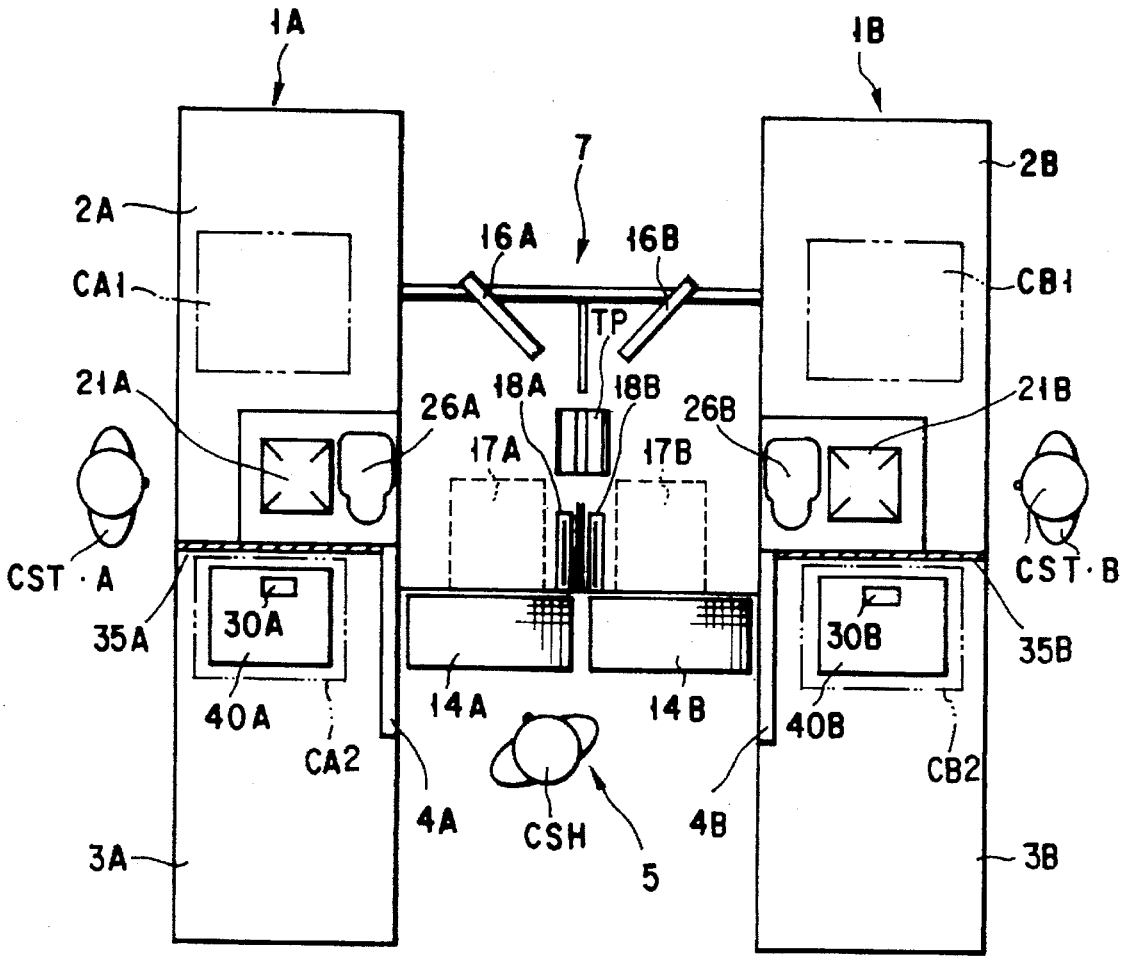
FIG. 1 is a plan view showing a first embodiment of this invention.
Figure 2:
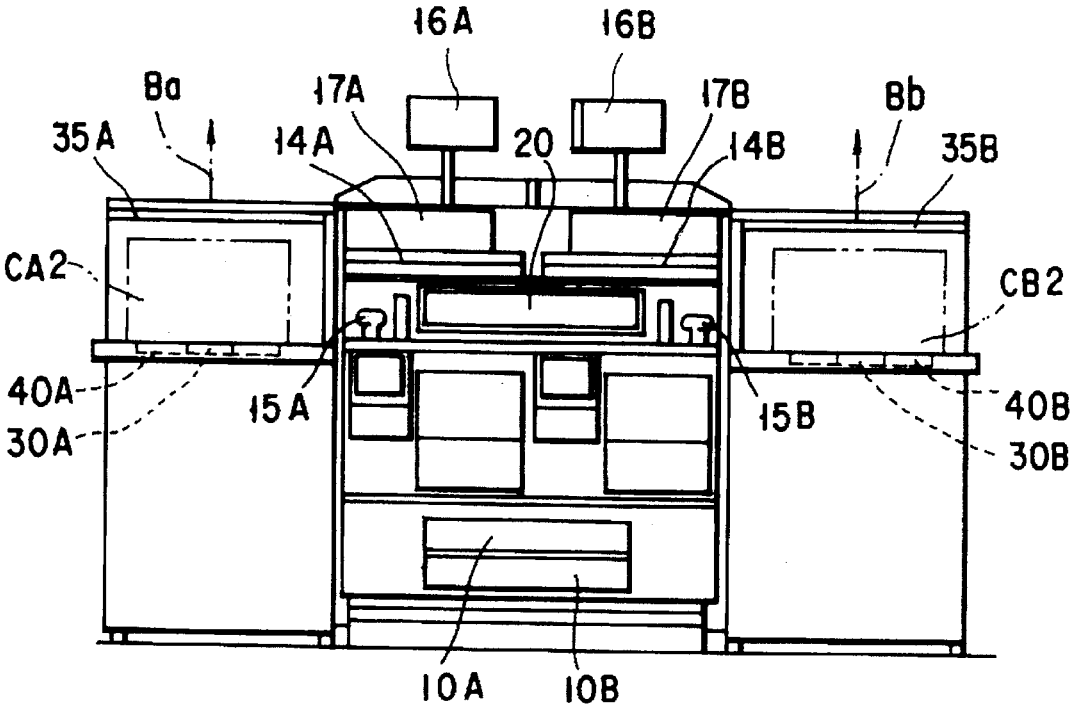
FIG. 2 is a front view showing the first embodiment of this invention.
Figure 3:
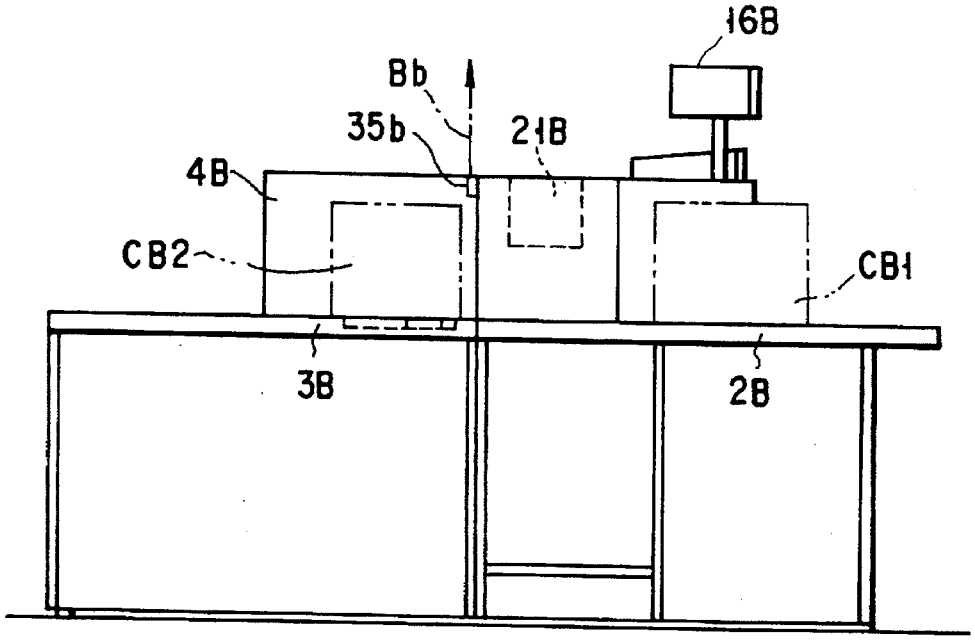
FIG. 3 is a side view showing the first embodiment of this invention.

There will now be described an embodiment of this invention with reference to the accompanying drawings.

FIGS. 1, 2, 3 and 4 are a plan view, front view, side view and block diagram showing a first embodiment of this invention.

In the above drawings, a self-scanning checkout apparatus has a settlement section 5, and two-lane (plural lane) self-scanning units 1A, 1B disposed on both sides of the settlement section together with partition walls 4A, 4B. The self-scanning unit 1A includes an upstream-side basket placing table 2A forming an unregistered article placing table, a stationary scanner 21A, cash receivers 26A, 26B, and a downstream-side basket placing table 3A forming a registered article placing table, when the article is registered, a basket CA1 having purchased articles received therein is placed on the upstream-side basket placing table 2A and an empty basket CA2 is placed 0n the downstream-side basket placing table 3A. A scale 40A which is one of the features of this invention is mounted on the table 3A and a passage detection sensor 35A including a light emitting element and an optical sensor is disposed between a stationary scanner 21A which will be described later and the table 3A. The tables 2A, 3A may be constructed by a conveyer or cart in some cases.

A customer CST-A takes out an article from the basket CA1 on the upstream side and self-scans the article by use of the stationary scanner 21A to input article data. Article data (such as an article code, article name, unit price) is displayed on the display 16A and can be visually recognized by the customer CST-A and cashier CSH. The self-scanned article is put into the basket CA2 on the downstream side by the customer CST-A. The self-scanning unit 1B has substantially the same construction.

In the settlement section 5, a settlement unit 7 capable of settling accounts based on registered article data for the customers CST-A and CST-B who self-scanned the articles along the respective self-scanning units 1A, 1B is disposed. The settlement unit 7 is constructed by two so-called electronic cash registers and includes keyboards 14A, 14B, displays 16A, 16B, printers 17A, 17B, card readers 18A, 18B, and a cellophane tape TP. Further, it includes handy scanners and drawers which are not shown in the drawing. They are controlled by the respective control sections 10A, 10B (CPU 11A, 11B, ROM 12A, 12B, RAM 13A, 13B).

The control section and drawer may be provided commonly for the self-scanning units 1A and 1B in some cases, but the function is substantially the same.

In the above self-scanning checkout apparatus, if the left side self-scanning unit 1A is considered, for example, the customer CST-A places the basket CA1 containing purchased articles on the upstream-side basket placing table 2A. The empty basket CA2 is placed on the downstream-side basket placing table 3A. The customer CST-A takes out an article from the basket CA1, scans the article by use of the stationary scanner 21A, and then puts the article into the basket CA2. Thus, the customer self-scans all of the purchased articles.

Article data read and input by the self-scanning is registered by the control section and displayed on the display 16A and printed on receipt paper by the printer 17A. After this, when the cashier CSH effects the settlement operation by use of the keyboard 14A, the total amount of money and the like are calculated. The total amount and the like are displayed on the display 16A and printed on the receipt paper.

Then, the customer CST-A puts cash corresponding to the total amount on-the cash receiver 26A for payment. The cashier CSH settles an account by use of the opened drawer and gives the change together with the receipt and a bag for putting the purchased articles therein to the customer. Thus, the settlement is ended, and the customer CST-A carries the basket CA2 on the downstream side and moves to a packing table (not shown). That is, the checkout is completed. The cashier CSH moves the upstream side basket CA1 which is now empty to the downstream-side basket placing table 3A.

During this time, the customer CST-B self-scans articles in substantially the same procedure as described above to read and input article data on the right side self-scanning unit 1B.

Therefore, according to the two-lane type self-scanning checkout apparatus, the efficiency of the service can be significantly enhanced and the labor cost can be markedly lowered in comparison with an apparatus of one-person system in which the scanning and settlement operations are effected by one cashier (CSH) or an apparatus of two-person system in which the scanning operation is exclusively effected by one checker and the settlement operation is effected by one cashier (CSH). Further, the waiting time of the customer (CST) becomes shorter and it is convenient.

Figure 4:
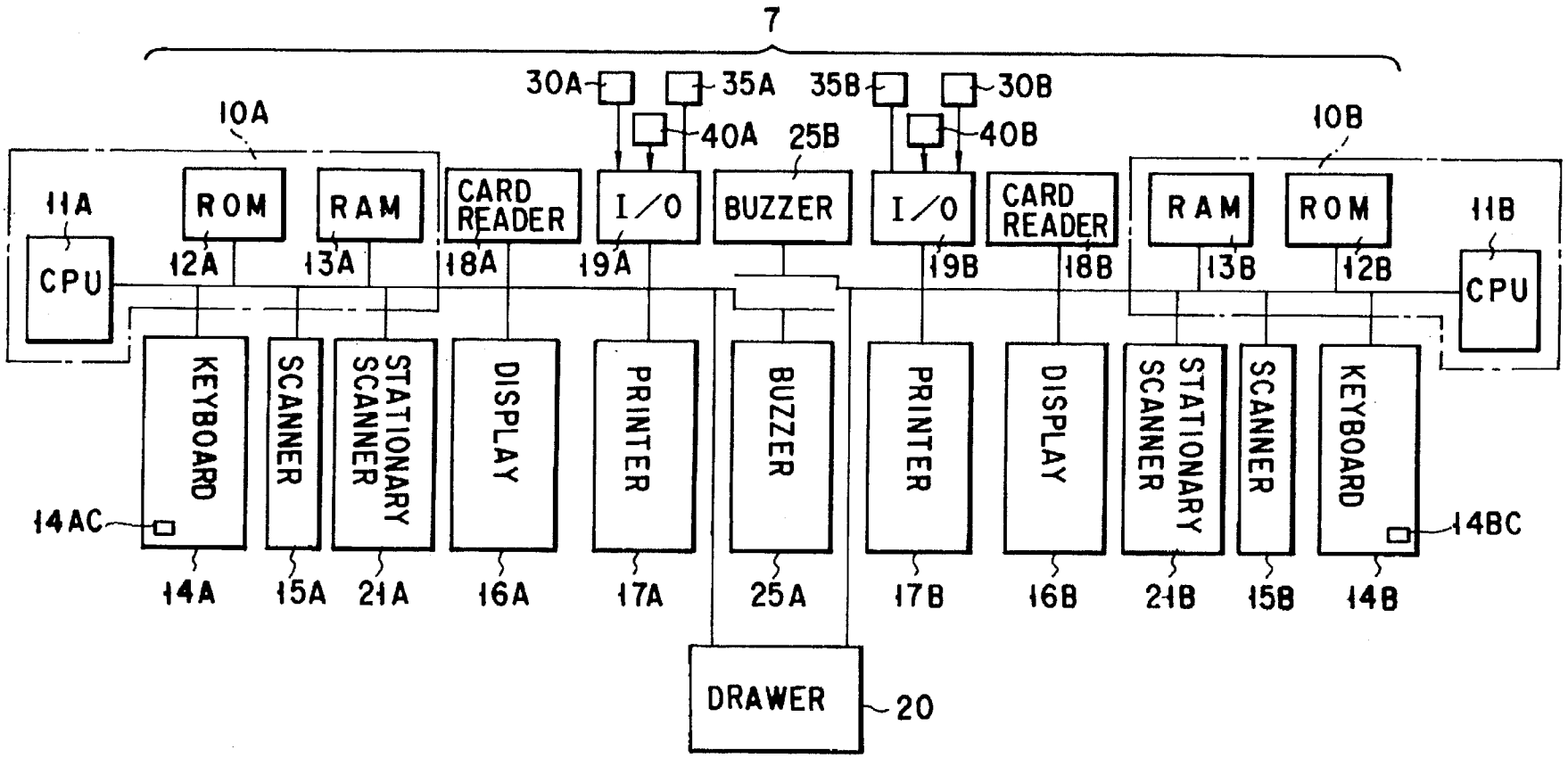
FIG. 4 is a block diagram showing the first embodiment of this invention.

The error detection function of this invention is explained in detail below together with the construction of the control device of FIG. 4. In FIG. 4, the settlement unit 7 provided in the settlement section 5 is constructed by two electronic cash registers corresponding to the self-scanning units 1A, 1B. However, the drawer 20 is used as a common drawer.

That is, one of the electronic cash registers which corresponds to the self-scanning unit 1A includes the control section 10A (CPU 11A, ROM 12A, RAM 13A), keyboard 14A, handy scanner 15A, display 16A, printer 17A, card reader 18A, and an input/output port (I/O) 19A, and effects the settlement process based on article data self-scanned by the stationary scanner 21A. The electronic cash register corresponding to the other self-scanning unit 1B has substantially the same construction (10B, 14B, 15B, 16B, 17B, 18B, 19B).

The displays 16A, 16B are mounted with an adequate angle so as to permit the cashier CSH and customers CST-A, CST-B to simultaneously and visually observe the same display content. Further, the electronic cash registers are connected to buzzers 25A, 25B which generate sounds of different frequencies. Reset keys 14AC, 14BC on the keyboards 14A, 14B are used to interrupt the buzzer sound and set flags as will be described later.

The passage detection sensor 35A disposed between the downstream-side basket placing table 3A and the stationary scanner 21A of the self-scanning unit 1A shown in the left side portion of FIG. 1 is an element for directly or indirectly detecting an article moved from the stationary scanner 21A to the basket CA2 on the downstream-side basket placing table 3A, and the type thereof is not specified, but in this embodiment, it is constructed by a reflection type passage detection sensor 35A including a plurality of light emitting elements and light receiving elements which are arranged in series.

That is, when an article or a hand holding the article crosses a detection light beam Ba projected from the passage detection sensor 35A, the passage of the article is detected according to a variation in the amount of reflected light. That is, since the passage detection sensor 35A is disposed Just behind the position of the stationary scanner 21A, it is possible to infer and detect that the article may have been self-scanned and registered.

The passage detection sensor 35B lying on part of the self-scanning unit 1B shown in the right side portion of FIG. 1 has substantially the same construction.

As shown in FIG. 4, the passage detection sensors 35A, 35B are connected to the control sections 10A, 10B via the input/output ports (I/O) 19A, 19B, respectively.

A scale 40A for detecting a variation in the weight of articles received in the basket CA2, that is, a variation in the weight of articles placed on the registered article placing table 3A is mounted on the downstream-side basket placing table 3A of the self-scanning unit 1A. In this embodiment, it is constructed by a scale 40A. Further, in order to precisely detect a variation in the weight of the articles, a fixed-position sensor (such as a limit switch) 30A is provided to determine whether or not the basket CA2 is correctly placed on the scale 40A.

A scale 40B and a fixed-position sensor 30B mounted on part of the self-scanning unit 1B have substantially the same construction.

The error signal output control operation is effected to output an error signal when the passage of an article is not detected by the passage detection sensor 35A ("NO" in the step 112) before detection of a variation in the weight of the articles in the basket CA2 even if a variation in the weight of the articles in the basket CA2 is detected by the scale 40A ("YES" in the step 116). The control operation is effected by the CPU 11A and ROM 12A storing the signal output control read program (which is included in the control section 10A) and is effected to output an error signal when the result of determination in the step 117 in FIG. 5B is "NO". As a result, the buzzer 25A is sounded.

Likewise, the error signal output control operation on the other lane 1B side is effected by the CPU 11B, ROM 12B and the buzzer 25B is sounded by the error signal.

Further, in this embodiment, in order to simplify the signal output control program, enhance the processing speed, and increase the application range of the error signal, the control operation for a pair of registration flags, registration/passage flags and unregistration/passage flags corresponding to self-scanning units 1A, 1B and the control operation for normal display, placement method guidance display, self-scanning operation guidance display, and caution display are effected.

Figure 5A:
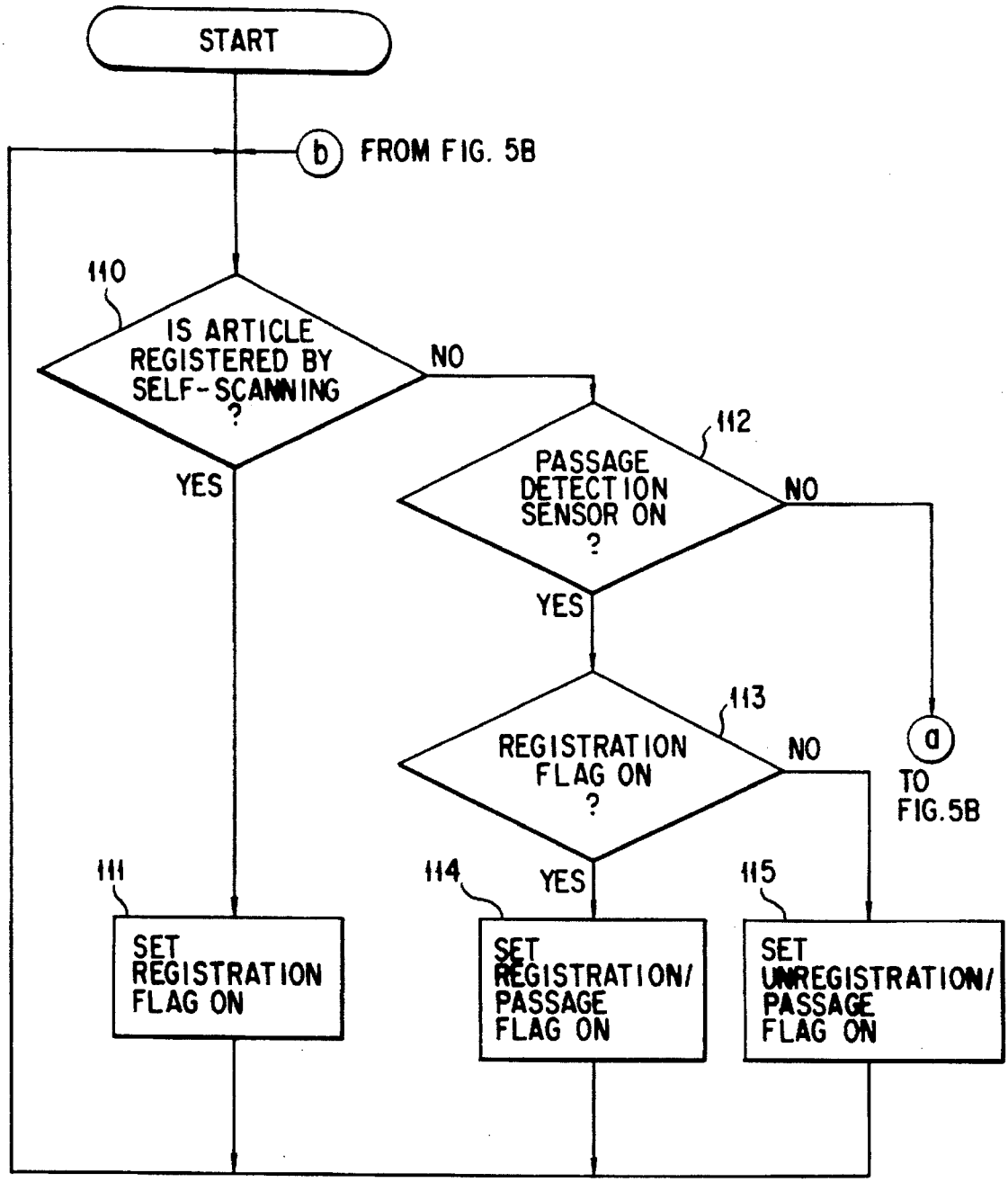
FIGS. 5A and 5B are flowcharts for illustrating the operation of the first embodiment of this invention.
Figure 5B:
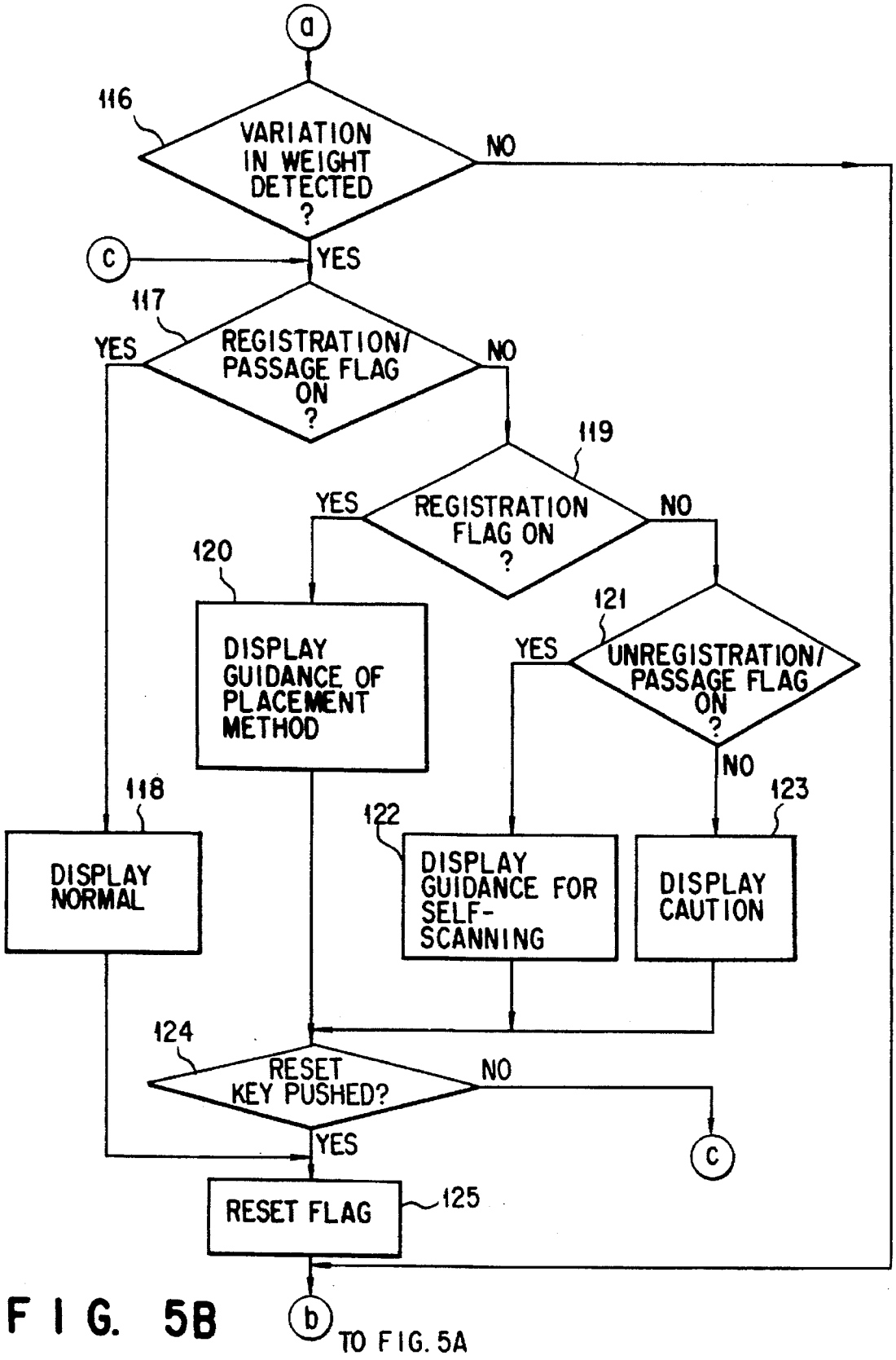

The registration flag control operation is effected by the CPU 11A and ROM 12A in the step 111 of FIG. 5A to set the registration flag ON in the RAM 13A when the article is correctly registered by reading the article information of the self-scanning operation by use of the stationary scanner 21A ("YES" in the step 110).

The registration/passage flag control operation is effected by the CPU 11A and ROM 12A (step 114) to set the registration/passage flag ON when the passage of the article is detected by the passage detection sensor 35A and the registration flag is set in the ON state ("YES" in the steps 112 and 113).

The unregistration flag control operation is effected by the CPU 11A and ROM 12A (step 115) to set the unregistration/passage flag ON in the RAM 13 when the passage of the article is detected ("YES" in the step 112) but the registration flag is not set in the ON state ("NO" in the step 113).

The normal display control operation is effected by the CPU 11A and ROM 12A to display the content of the normal display on the display 16A in a case wherein a variation in the weight is detected ("YES" in the step 116) and the registration/passage flag is set in the ON state ("YES" in the step 117) before detection of the variation in the weight.

The error signal output control operation is explained. An error signal is output to sound the buzzer 25A when the result of determination in the step 116 of FIG. 5B is "YES" and the result of determination in the step 117 is "NO". This is because the article is put into the basket CA2 on the downstream side even though the scanning operation is not correctly effected or when the scanning operation is correctly effected but the article registration is not effected.

The placement method guidance display control operation is effected to display the placement method guidance on the display 16A if the registration flag is set in the ON state ("YES" in the step 119) when an error signal is output ("NO" in the step 117). The control operation is effected by the CPU 11A and ROM 12A (step 120). That is, the control operation is effected when the customer has correctly scanned the article, but has put the article into the basket CA2 on the downstream-side basket placing table 3A without passing the article along the passage detection sensor 35A, for example. In this case, a guidance "please put the article straight into the basket after scanning" is displayed, for example.

The self-scanning operation guidance display control operation is effected to display a self-scanning operation guidance (for example, "please scan again") on the display 16A when an error signal is output ("NO" in the step 117) on a condition that the registration flag is not set in the ON state ("NO" in the step 119) but only the unregistration/passage flag is set in the ON state ("YES" in the step 121).

The caution display control operation is effected by the CPU 11A and ROM 12A and is indicated by the step 123. That is, if an error signal is output ("NO" in the step 117) and neither the registration flag nor the unregistration/passage flag is set in the ON state ("NO" in the steps 119 and 121), caution is displayed on the display 16A. For example, it is considered to display the caution "please put only the article which is correctly scanned into the basket". That is, the display is made to call the customer's attention and inform the cashier CSH that the possibility of dishonest act is extremely strong.

In a case where there are many people of evil intention, for example, a mark which permits only the cashier CSH to recognize occurrence of dishonest act may be displayed on the display 16A.

The flag reset control operation except normal mode is effected to reset a flag (step 124, 125) when the reset key 14AC on the keyboard 14 is depressed.

Time management may be effected to automatically reset the flag. The sound of the buzzer 25A is also interrupted.

The above operations are the same as those for the other lane 1B.

The operation of the first embodiment is explained below with reference to the flowchart of FIGS. 5A and 5B.

In the left side lane 1A shown in FIG. 1, the basket CA1 having purchased articles of the customer CST-A received therein is placed on the upstream-side basket table 2A forming the unregistered article placing table and an empty basket CA2 is placed in the fixed-position of the downstream-side basket placing table 3A forming the registered article placing table. Then, since the fixed-position sensor 30A is set ON, the scale 40A is set ready for detection of a variation in the weight and the article registration is permitted. That is, it becomes possible to self-scan an article by use of the stationary scanner 21A. The scanning possible state is displayed on the display 16A.

At this time, if the customer CST-A takes out the article from the basket on the upstream side and self-scans the article by use of the stationary scanner 21A, the control section 10A effects the article registration if the reading input is correct. Article data is displayed on the display 16A and printed on receipt paper by the printer 17A. Then, the registration flag in the RAM 13 is set ON ("YES" in the step 110, and step 111).

If the customer CST-A who has self-scanned the article moves the article towards the downstream side, the passage detection sensor 35A detects the passage of the article ("YES" in the step 112). In this case, if the registration flag is set in the ON state ("YES" in the step 113), the registration/passage flag is set ON (step 114). If the registration flag is not set in the ON state ("NO" in the step 113), the unregistration/passage flag is set ON (step 115).

At this time, if a variation in the weight of the articles in the basket CA2 on the downstream-side basket placing table 3A is detected ("YES" in the step 116), the state in which the normal cash-out process is effected is displayed on the display 16A (step 118) if the registration/passage flag is set in the ON state ("YES" in the step 117).

Therefore, for example, the registration flag and registration/passage flag are reset by the flag reset control operation (1A, 12A) (step 124, 125) and the customer CST-A can self-scan the next article. In this case, it is assumed that no error has occurred.

However, even if a variation in the weight of articles in the basket CA2 is detected by the scale 40A ("YES" in the step 116) and the passage of the article is not detected by the passage detection sensor 35A ("NO" in the step 112) before detection of the variation in the weight, that is, when the registration/passage flag is not set in the ON state ("NO" in the step 117), an error signal is output. The buzzer 25A is sounded by the error signal. As a result, the cashier CSH can get information of occurrence of abnormal condition and, for example, the cashier can get information of occurrence of abnormal condition on the lane 1A side even if she is settling an account on the lane 1B side.

In this case, if the registration flag is set in the ON state ("YES" in the step 119) even when the error signal is output, the placement method guidance is displayed on the display 16A (step 120). For example, the guidance "please put the self-scanned article straight into the basket CA2" is displayed.

On the other hand, if the registration flag is not set in the ON state ("NO" in the step 119) and the unregistration/passage flag is set in the ON state ("YES" in the step 121), the guidance for the self-scanning operation is displayed on the display 16A (step 122). That is, it is possible to teach the self-scanning method to the customer CST-A who is inexperienced in the self-scanning operation. Further, if an effective reading cannot be input, the cashier may ask the customer to self-scan the article again.

If an error signal is output ("NO" in the step 117) and the registration flag and unregistration/passage flag are both set in the ON state ("NO" in the steps 119 and 121), the caution "please put only the correctly self-scanned article into the basket" is displayed on the display 16A (step 123), for example.

In this case, since the possibility that the customer CST-A puts the article which is taken out from the basket CA1 or held in his hand into the basket CA2 without self-scanning is strong, the cashier CSH may give strict caution to the customer.

After this, the respective flags are reset (step 124, 125) by depressing the reset key 14AC and the self-scanning for the article or a next article can be re-started. The sound of the buzzer 25A is also stopped.

The same operation as described above is effected for the other lane 1B.

As described above, according to the first embodiment, the passage detection sensors 35A, 35B, scales 40A, 40B and the output signal controlling units 11A, 12A, 11B, 12B are provided, and an error signal is output if a variation in the weight of the articles in the basket CA2, CB2 on the downstream-side basket placing table 3A, 3B forming the registered article placing table is detected by the scale 40A, 40B but the passage of an article is not detected by the passage detection sensor 35A, 35B before detection of a variation in the weight of the articles. Therefore, it becomes possible to easily and unfailingly inform the cashier that an article which is assumed not to be registered is put into the basket CA2, CB2 on the downstream side irrespective of the result of self-scanning or the presence of evil intention. Thus, the cashier CSH can easily get information that an unregistered article is accidentally or intentionally put into the basket CA2, CB2 on the downstream side without notice even if she does not always watch the customers. As a result, the mental load of the cashier can be markedly alleviated and the efficiency of the service can be kept high, and it becomes possible to previously prevent occurrence of dishonest act and give a kind advice to the customer who is inexperienced.

Further, by sounding the buzzer 25A, 25B by use of an error signal, the cashier CSH can more stably get information that an unregistered article is put into the basket CA2, CB2 on the downstream side irrespective of her position.

Since the passage detection sensor 35A, 35B is disposed between the stationary scanner 21A, 21B and the downstream-side basket placing table 3A, 3B, it becomes possible to unfailingly detect the passage of a self-scanned article by use of the stationary scanner 21A, 21B and it becomes difficult to detect the passage of an article which is not self-scanned.

Further, display of caution is provided, and if only a variation in the weight is detected without detecting the registration of an article and the passage of the article, it is determined that there is an extremely strong possibility of occurrence of dishonest act and caution is given to previously prevent the dishonest act from being actually performed.

The guidance of the self-scanning operation is displayed to give a kind advice on the self-scanning operation to a customer who is inexperienced. Therefore, the service for the customer can be improved and the load of the cashier is alleviated.

Further, the placement method guidance is displayed, and even if a self-scanned article is not directly put into the basket CA2, CB2, the customer CST-A, CST-B of good intention can be prevented from feeling uncomfortable since the placement method guidance is displayed.

Figure 7A:
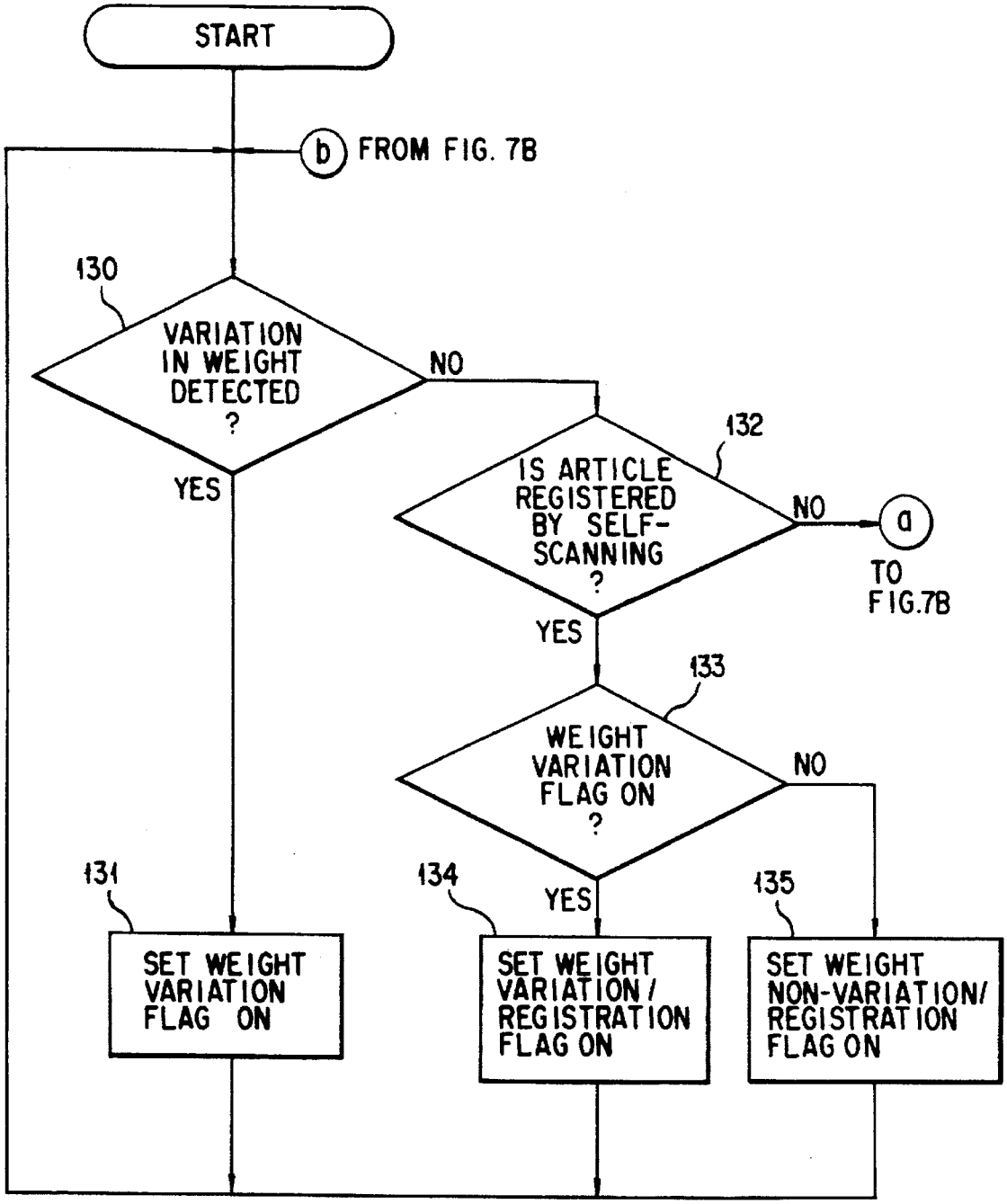
FIGS. 7A and 7B are flowcharts for illustrating the operation of the second embodiment of this invention.
Figure 7B:
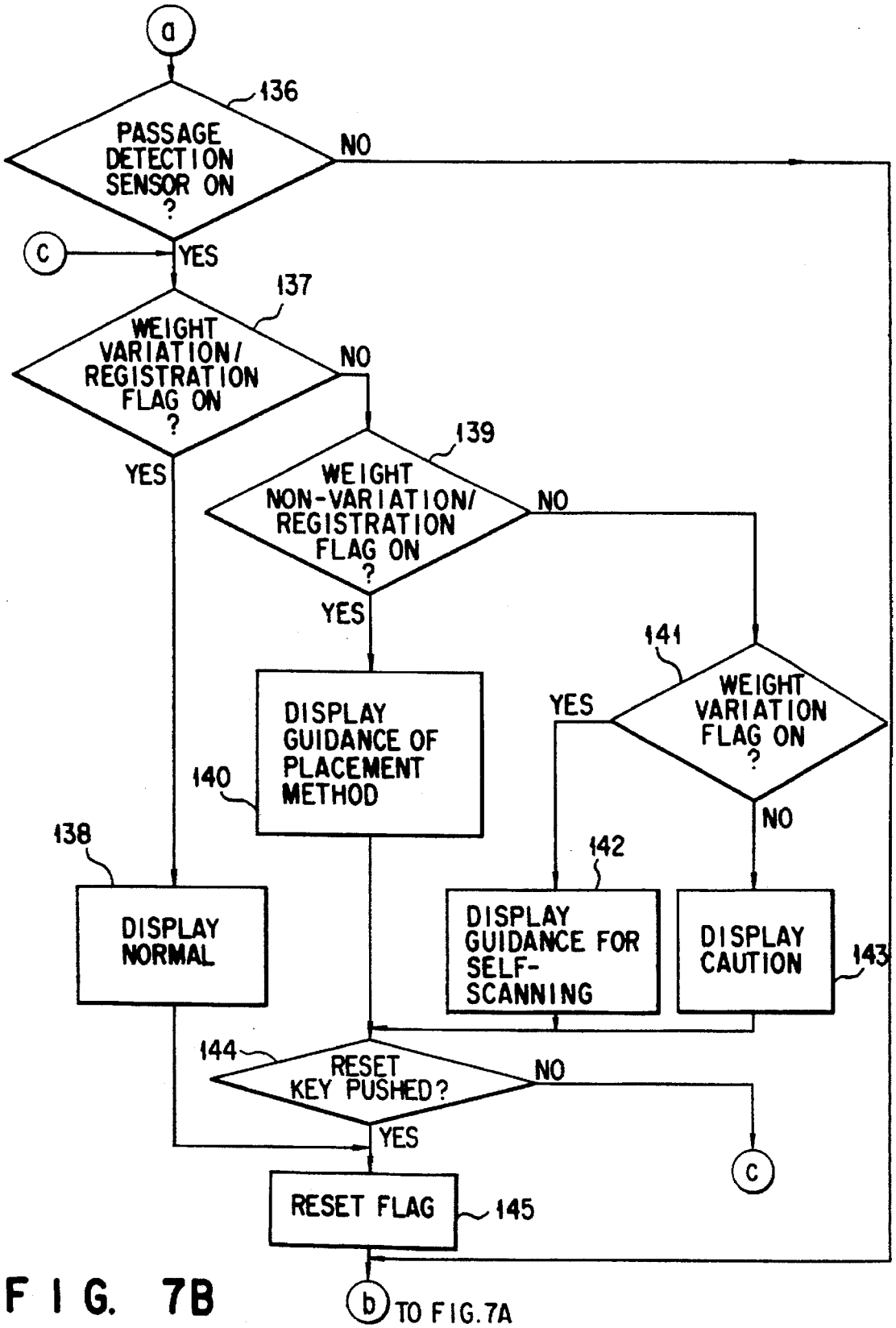

Next, the second embodiment of this invention is explained below with reference to the accompanying drawings. FIGS. 7A and 7B are flowcharts for illustrating the operation of the second embodiment of this invention.

Figure 6:
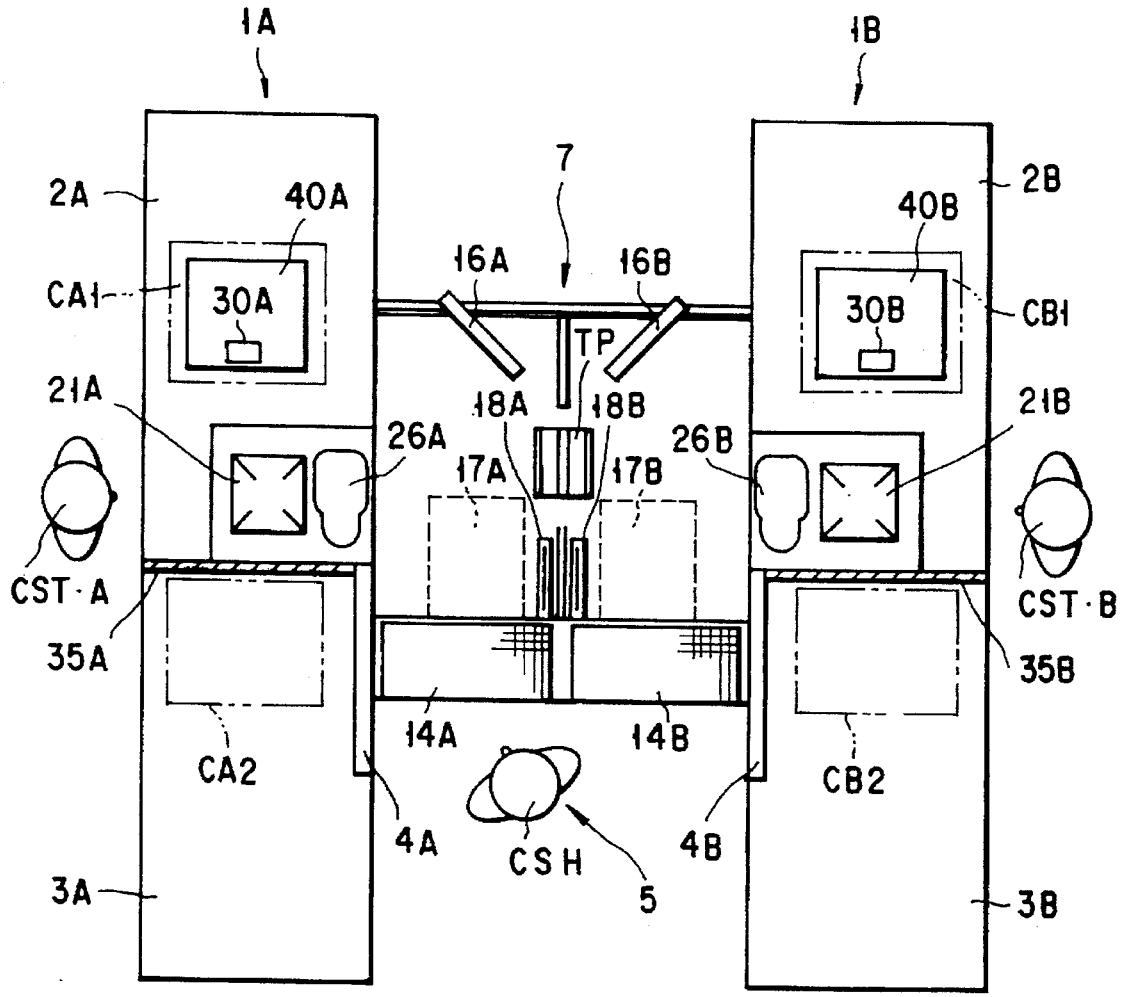
FIG. 6 is a plan view showing a second embodiment of this invention.

Unlike the first embodiment in which the scales 40A, 40B are mounted on the downstream-side basket placing tables 3A, 3B as shown in FIG. 6, in the second embodiment, the scales 40A, 40B are mounted on the upstream-side basket placing tables 2A, 2B. Therefore, it is designed to output an error signal when a variation in the weight is not detected by the scale 40A, 40B ("NO" in the step 136) before detection of the passage of an article even if the passage of the article is detected by the passage detection sensor ("YES" in the step 136).

Further, a weight variation flag, weight variation/passage flag and weight non-variation/registration flag are respectively used instead of the registration flag, registration/passage flag and unregistration/passage flag in the first embodiment by the CPU 11A, ROM 12A, CPU 11B and ROM 12B for the respective control operations.

In the case of the second embodiment with the above construction, when an article is taken out from the basket CA1 on the upstream-side basket placing table 2A forming the unregistered article placing table, the scale 40A detects a variation in the weight ("YES" in the step 130). As a result, the weight variation flag in the RAM 13A is set ON (step 131).

When the article of the customer CST-A is registered by the self-scanning by use of the stationary scanner 21A ("YES" in the step 132), the weight variation/registration flag is set ON (step 134) if the weight variation flag is set in the ON state ("YES" in the step 133).

At this time, if the weight variation flag is not set in the ON state ("NO" in the step 143), the weight non-variation/registration flag is set ON (step 135).

Next, when the passage of the article is detected by the passage detection sensor ("YES" in the step 136), the fact that the checkout process by the customer is normal is displayed (step 138) if the weight variation/registration flag is set in the ON state ("YES" in the step 137). Finally, the weight variation flag, weight variation/registration flag and the like are reset (step 144, 145). After resetting, the customer CST-A can self-scan the next article. In this case, no error signal is output.

However, an error signal is output in a case wherein a variation in the weight of the articles in the basket CA1 is not detected by the scale 40A ("YES" in the step 130) before detection of the passage of the article even though the passage of the article is detected ("YES" in the step 136), that is, in a case where the weight variation/registration flag is not set in the ON state ("NO" in the step 137). As a result, the buzzer 25A is sounded and the cashier CSH can recognize that the checkout process by the customer is not normal. For example, even if the cashier is settling an account on the lane 1B side, she can recognize that an abnormal condition has occurred on the lane 1A side.

In a case wherein the weight non-variation/registration flag is set in the ON state ("YES" in the step 139) even if an error signal is output, the placement method guidance is displayed on the display 16A (step 140). That is, the article which is held in hand and is not taken out from the basket CA1 on the upstream side is correctly self-scanned and registered, and therefore, the guidance "please take out the article from the basket and scan the article" is displayed, for example.

On the other hand, when the weight non-variation/registration flag is not set in the ON state ("NO" in the step 139) but the weight variation flag is set in the ON state ("YES" in the step 141), the guidance for the self-scanning operation is displayed on the display 16A (step 142). That is, in this case, since it is considered that the self-scanning operation is not successfully effected, it is possible to teach the self-scanning method to the customer CST-A who is inexperienced.

If an error signal is output ("NO" in the step 117) and neither the weight non-variation/registration flag nor the weight variation flag is set in the ON state ("NO" in the steps 139 and 131), the caution "please put only the correctly self-scanned article into the basket CA2" is displayed on the display 16, for example. In this case, the cashier must keep more careful watch on the customer.

The same operation as described above is effected for the other lane 1B and the explanation therefor is omitted.

As described above, according to the second embodiment, the scales 40A, 40B and passage detection sensors 35A, 35B are mounted on the upstream-side tables 2A, 2B. An error signal is output by the control of the CPU 11A, 11B, ROM 12A, 12B if a variation in the weight of the articles in the basket on the upstream-side basket placing table 2A, 2B forming the unregistered article placing table is not detected by the scale 40A, 40B before detection of the passage of the article even though the passage of an article is detected by the passage detection sensor 35A, 35B. Therefore, it becomes possible to easily and unfailingly inform the cashier CSH that an article which is held in hand and is not registered is put into the registered article placing the baggage CA2, CB2 mounted on table 3A, 3B irrespective of the result of self-scanning or the presence of evil intention.

Thus, the cashier CSH can easily get information that an article which is held in hand and is not registered may be accidentally or intentionally put into the basket CA2, CB2 on the downstream side even if she does not always watch he customers.

The effects of sounding of the buzzer 25A, 25B, display of caution, and display of the guidance for the self-scanning are the same as those of the first embodiment.

In he above embodiments, the unregistered article placing tables are constructed by the upstream-side basket placing tables 2A, 2B, and the registered article placing tables are constructed by the downstream-side basket placing tables 3A, 3B, but each of the unregistered article placing tables and the registered article placing tables may be constructed by use of a conveyer or cart. Further, the registered article placing table can be constructed by an automatic bagging machine.

The checkout apparatus of this invention checks the three results Of detection of a variation in the weight caused by transfer of an article, detection of the passage of an article by the passage detection sensor and detection of registration of an article by the scanner or the like and determines that the checkout process of the customer is abnormal when at least one of the "detected" results is not obtained. As a result, the cashier can easily and unfailingly get information that an article which is not registered by use of the scanner is placed on the registered article table by use of a lamp or the like which informs the result of determination without always watching the customer.

Further, adequate information such as the scanning guidance and the guidance of placement of the article on the table is displayed for the customer according to the preset program based on a combination of those of the above three results of detection (weight variation, passage of the article, registration of the article) which indicate non-detection.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A self-scanning checkout apparatus for reading article information of articles to be purchased during a checkout operation carried out individually by a customer and for determining whether the check-out operation individually carried out by the customer is normal or abnormal, said self-scanning checkout apparatus comprising:

first holding means for holding articles to be purchased whose article information is not yet read, said first holding means including first weight variation detecting means for detecting a variation in weight of articles held by said first holding means;

reading means, operable individually by the customer, for reading article information of the articles to be purchased;

second holding means for holding articles to be purchased whose information has been read;

registering means for registering the article information read by said reading means;

passage detecting means, disposed between said first and second holding means and in the vicinity of said reading means, for detecting passage of articles;

second weight variation detecting means, disposed on said second holding means and in the vicinity of said passage detecting means, for detecting a variation in the weight of articles held by said second holding means; and determining means for determining whether the checkout process carried out individually by the customer is normal or abnormal based on outputs from said registering means, said passage detecting means, said first weight variation detecting means, and said second weight variation detecting means, which outputs respectively indicate the detection or non-detection of registration of an article, passage of the article, a weight variation in the weight of articles held by said first holding means, and a weight variation in the weight of articles held by said second holding means.

2. The self-scanning checkout apparatus according to claim 1, further comprising display means for displaying a message responsive to the determination of said determining means.

3. The self-scanning checkout apparatus according to claim 2, wherein said display means includes:

means for displaying a message indicating that an article should be placed in said second holding means when registration of the article is detected but weight variation in the weight of articles held by said second holding means is not detected;

means for displaying a message indicating that an article should be re-read by said reading means when passage of the article and weight variation in the weight of articles held by said second holding means are detected but when registration of the article is not detected; and means for displaying a message indicating a customer caution alert when weight variation in the weight of articles held by said second holding means is detected but when both passage of an article and registration of the article are not detected.

4. The self-scanning checkout apparatus according to claim 1, wherein said determining means includes a microcomputer having a flag for indicating detection or non-detection of registration of an article, a flag for indicating detection or non-detection of passage of an article, and a flag for indicating detection or non-detection of weight variation in the weight of articles held by said second holding means.

5. The self-scanning checkout apparatus according to claim 1, wherein said passage detecting means includes a light emitting element and an optical sensor.

6. A self-scanning checkout apparatus for reading article information of articles to be purchased during a checkout operation carried out individually by a customer and for determining whether the check-out operation individually carried out by the customer is normal or abnormal, said self-scanning checkout apparatus comprising:

first holding means for holding articles to be purchased whose article information is not yet read;

weight variation detecting means, disposed on said first holding means, for detecting a variation in the weight of articles held by said first holding means;

reading means, operable individually by the customer, for reading article information of the articles to be purchased;

second holding means for holding articles to be purchased whose information has been read;

registering means for registering the article information read by said reading means;

passage detecting means, disposed between said first and second holding means and in the vicinity of said reading means, for detecting passage of articles; and determining means for determining whether the checkout process carried out individually by the customer is normal or abnormal based on outputs from said registering means, said passage detecting means and said weight variation detecting means respectively indicating the detection or non-detection of registration of an article, passage of the article and a weight variation in the weight of articles held by said first holding means.

7. The self-scanning checkout apparatus according to claim 6, further comprising display means for displaying a message responsive to the determination of said determining means.

8. The self-scanning checkout apparatus according to claim 7, wherein said display means includes:

means for displaying a message indicating that an article should be re-read by said reading means when passage of the article and weight variation in the weight of articles held by said first holding means are detected but when registration of the article is not detected; and means for displaying a message indicating a customer caution alert when passage of an article is detected but when both registration of the article and weight variation in the weight of articles held by said first holding means are not detected.

9. The self-scanning checkout apparatus according to claim 6, wherein said determining means includes a microcomputer having a flag for indicating detection or non-detection of registration of an article, a flag for indicating detection or non-detection of passage of an article, and a flag for indicating detection or on-detection of weight variation in the weight of articles held by said first holding means.

10. The self-scanning checkout apparatus according to claim 6, wherein said passage detecting means includes a light emitting element and an optical sensor.

* * * * *